United States Patent [19]

Asanae et al.

[11] Patent Number: 4,865,936

[45] Date of Patent: Sep. 12, 1989

[54] ELECTROPHOTOGRAPHIC REVERSAL DEVELOPMENT METHOD USING MAGNETIC FIELD AND SPECIFIED DEVELOPMENT GAP

[75] Inventors: Masumi Asanae, Kumagaya; Toshio Kumakura, Omiya, both of Japan

[73] Assignee: Hitachi Metals, Ltd., Tokyo, Japan

[21] Appl. No.: 185,242

[22] Filed: Apr. 18, 1988

Related U.S. Application Data

[63] Continuation of Ser. No. 935,020, Nov. 26, 1986, abandoned.

[30] Foreign Application Priority Data

| | | | |
|---|---|---|---|
| Nov. 29, 1985 | [JP] | Japan | 60-268787 |
| Jan. 14, 1986 | [JP] | Japan | 61-6040 |
| Jan. 14, 1986 | [JP] | Japan | 61-6041 |
| Feb. 6, 1986 | [JP] | Japan | 61-24726 |
| Feb. 6, 1986 | [JP] | Japan | 61-24727 |

[51] Int. Cl.[4] ..... G03G 13/09

[52] U.S. Cl. ..... 430/100; 430/122; 355/268; 355/251

[58] Field of Search ..... 430/100, 122; 355/140

[56] References Cited

U.S. PATENT DOCUMENTS 2,846,333 11/1955 Wilson ..... 430/107

4,021,358 5/1977 Tomono et al. .

4,350,749 9/1982 Ohnuma ..... 430/100

FOREIGN PATENT DOCUMENTS 1427760 3/1976 United Kingdom .

*Primary Examiner*—J. Davis Welsh

*Attorney, Agent, or Firm*—Finnegan, Henderson, Farabow, Garrett & Dunner

[57] ABSTRACT

A reversal development method comprising the steps of forming a latent electrostatic image on the surface of an image-carrying member having predetermined charging characteristics; supplying a developer to a non-magnetic, conductive sleeve containing a magnetic field-generating means and positioned opposite to the image-carrying member, the developer comprising a magnetic toner consisting essentially of a resin and magnetic powder and adapted to be charged with the opposite polarity to that of the latent electrostatic image; conveying the developer onto the image-carrying member surface by relative rotation of the sleeve to the magnetic field-generating means; and applying DC voltage of the same polarity as that of the latent electrostatic image to the sleeve so that the magnetic toner is attracted to the nonimage areas of the latent electrostatic image. The present invention can provide high-quality images with high optical density and resolution substantially without suffering from dispersed toner dust adhesion.

8 Claims, 1 Drawing Sheet

ELECTROPHOTOGRAPHIC REVERSAL DEVELOPMENT METHOD USING MAGNETIC FIELD AND SPECIFIED DEVELOPMENT GAP

This application is a continuation of application Ser. No. 935,020, filed Nov. 26, 1986, now abandoned.

BACKGROUND OF THE INVENTION

The present invention relates to a reversal development method for providing reversal toner images by causing magnetic toners to adhere to the uncharged areas of a latent electrostatic image formed on an image-carrying member surface.

Encouraged by wide use of computers in recent years, developments have been made actively on printers as peripheral equipment for producing hard copies as the outputs of information in the form of letters and figures. The printers which were most commonly used conventionally are so-called impact-type printers which produce prints by physically impinging selected printing types upon papers via ink ribbons. However, the appearance of higher-performance computers and the diversification of information to be processed have necessitated the quick processing of large amounts of information and various types of output forms such as various sizes of letters such as Chinese characters and figures. These requirements cannot be met by the conventional impact-type printers, so efforts have been made to develop new non-impact-type printers (electronic printers).

The nonimpact-type printers are classified into three groups; an electrophotographic type, an electrostatic type and a ink jet type from the viewpoint of recording methods. In order to cope with the recent trends of increase in recording speeds and densities, the electrophotographic type appears to be the most promising.

The principles of recording by electrophotographic printers are essentially the same as those of usual copiers: The recording process comprises the steps of uniformly charging a photosensitive member surface, forming a latent electrostatic image by exposure, developing the latent electrostatic image with a toner, transferring the toner image onto a plain paper and fixing. Since in the electrophotographic printer, information supplied from a computer is written on a uniformly charged photosensitive surface with a laser beam, etc., and toner is caused to attach to the written areas, namely the exposed areas of the surface, development should be done in reverse.

Dry developers for the reversal development are usually two component-type developers which consist of magnetic carriers and non-magnetic toners like those for copiers. Most printers now in use utilize such developers.

When the two component-type developers are used, the toners have enough electrostatic charges due to the triboelectrification with the carriers so that they can produce exact development of the nonimage areas of the latent electrostatic image. Further, since the toners retain electrostatic charges after the development, the toner image can be electrostatically transferred onto a commonly available plain paper, resulting in high-quality print image. The use of the two component-type developers, however, requires means for keeping carrier-toner mixtures at constant mixing ratios to maintain the constant optical densities of the resulting images, resulting in larger and more complicated developing apparatuses. In addition, the mixing and stirring of the carriers with the toners for extended periods of time leads to the formation of toner layers on the carrier surfaces, deteriorating the triboelectric characteristics of the carriers, which requires the periodic replacement of the carriers.

To solve these problems, one component-type developers consisting only of magnetic toner particles as dry developing components for developing latent electrostatic images have been developed and put into practical use.

In a reversal development method using the so-called magnetic toners, the toners are generally attracted to the nonimage areas by applying DC bias voltage of the same polarity as that of the latent electrostatic image to a conductive sleeve holding the magnetic toners charged with the same polarity as that of the electrostatic image. In order that the magnetic toners can be charged with the predetermined polarity, they should be a chargeable type containing charge controlling agents in the inner and/or the surface thereof. See Japanese Patent Laid-Open No. 55-48754. Such chargeable magnetic toners are caused to have charges by contact with a sleeve or a doctor blade or with each other.

In the electrostatic transfer of the toner image produced by the development onto a transfer sheet, it is common to use insulating magnetic toners having high electric resistance in order to prevent the deterioration of the transferred image. See, for instance, U.S. Pat. No. 4,121,931.

However, when the insulating magnetic toners of the above-mentioned chargeable type are charged with the same polarity as that of the latent electrostatic image to conduct reversal development, it is actually inevitable that they are inferior to the two component-type developers in terms of image qualities. Specifically, when the magnetic toners adapted to be charged with the same polarity as that of the latent electrostatic image are used, they can provide image densities on the same level as those of the two component-type developers, but they fail to give sufficient resolution, and images developed therewith tend to have dust consisting of dispersed toner particles adhered around their peripheries.

OBJECT AND SUMMARY OF THE INVENTION

An object of the present invention is, therefore, to provide a reversal development method which can provide much higher image qualities than those conventional ones by using magnetic toners.

Intense research in view of the above object has revealed that the use of magnetic toners adapted to be charged with the opposite polarity to that of the latent electrostatic image can provide a sharp image contrast with higher resolution than that of the conventional one and with extremely little dispersed toner dust. This finding is contrary to the common belief that in the reversal development of latent electrostatic image with magnetic toners the magnetic toners adapted to be charged with the same polarity as that of the latent electrostatic image should be used.

Thus, the reversal development method according to the present invention comprises the steps of forming a latent electrostatic image on the surface of a photosensitive member having predetermined charging characteristics; supplying a developer to a non-magnetic, conductive sleeve containing a magnetic field-generating means and positioned opposite to the photosensitive member, the developer comprising a magnetic toner consisting essentially of a resin and magnetic powder and adapted to be charged with the opposite polarity to that of the latent electrostatic image; conveying the developer onto the image-carrying photosensitive member surface by relative rotation of the sleeve to the magnetic field-generating means; and applying DC voltage of the same polarity as that of the latent electrostatic image to the sleeve so that the magnetic toner is attracted to the nonimage areas of the latent electrostatic image.

DESCRIPTION OF THE PREFERRED EMBODIMENTS

Figure 1:
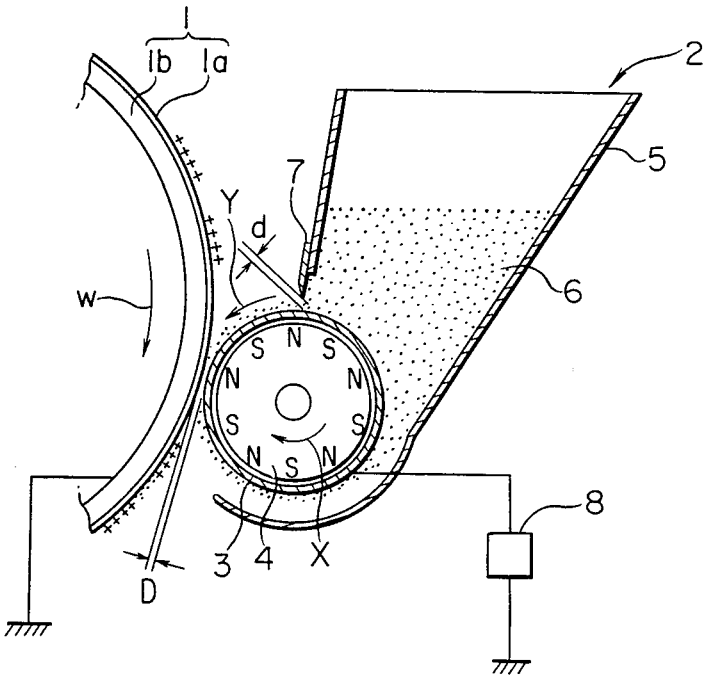
FIG. 1 is a cross-sectional view of a developing apparatus for conducting the method of the present invention.

FIG. 1 is a cross-sectional view of a developing apparatus for carrying out the method of the present invention.

A photosensitive drum 1 has a photoconductive layer 1*a* supporting a latent electrostatic image shown by the symbol "+" in the figure and a conductive substrate 1*b* electrically grounded. The drum 1 is rotated in the direction as shown by the arrow W. A developing apparatus 2 is composed of a sleeve 3 positioned opposite to the photosensitive drum 1, a permanent magnet means 4 having a plurality of magnetic poles on its surface and contained in the sleeve 3, a container 5 for containing a magnetic toner 6, and a doctor blade 7 mounted to the container 5 at its opening for defining a doctor gap d for regulating the thickness of the magnetic toner 6 conveyed on the sleeve 3. The sleeve 3 is made of non-magnetic, conductive materials such as austenitic stainless steel and aluminum alloys, and electrically connected with a DC power supply 8.

This developing apparatus is operated as follows to conduct the reversal development. By relative rotation of the sleeve 3 to the permanent magnet means 4, the magnetic toner 6 contained in the toner container 5 is withdrawn onto the sleeve 3 and conveyed from the doctor gap d to a developing gap D as shown by the arrow Y. Since the magnetic toner has triboelectric charging characteristics which give it charges with the opposite polarity to that of the latent electrostatic image, the magnetic toner particles are charged with the opposite polarity to that of the latent electrostatic image by contact with the sleeve 3 and the doctor blade 7 and with each other in the course of conveying. When the charged magnetic toner particles 6 has entered into a developing zone defined by the photosensitive drum 1 and the sleeve 3, they are attracted to the nonimage areas of the latent image on the drum surface, forming a toner image. This toner image is conveyed to a transfer position by the rotation of the photosensitive drum 1, and transferred to a transfer sheet (not shown) by applying an electric field of the opposite polarity to that of the latent electrostatic image to the back side of the transfer sheet. The transferred toner image is then fixed.

Although it might be considered from the belief admitted widely hitherto that the use of the magnetic toner adapted to be charged with the opposite polarity to that of the latent electrostatic image would lead to the attraction of such magnetic toner to the image areas of the latent electrostatic image, experiments conducted by the inventors have revealed that it is actually attracted to the nonimage areas of the latent electrostatic image.

Further, the experiments have led to the findings that the magnetic toner preferably has triboelectric characteristics which are a triboelectric charge of 1–20 μc/g as absolute value when measured by a blow-off method, and that its surface potential generated on the surfaces by rotation of the toner particles is preferably 10–90V as absolute value. This is because excessive triboelectric charge and surface potential lead to the decrease in optical density while insufficient triboelectric charge and surface potential lead to more fogging. The most preferred ranges of the triboelectric charge and the surface potential are 3–10 μc/g and 30–60V, respectively as absolute values.

The above ranges of the triboelectric charge and the surface potential may vary a little depending on the polarities of the latent electrostatic images and the types of the toners used. For instance, when a pressure fixing-type magnetic toner is used for developing a negative latent electrostatic image, the toner preferably has a triboelectric charge of 2–20 μc/g and a surface potential of 5–60V. And when a pressure fixing-type magnetic toner is used for developing a positive latent electrostatic image, the triboelectric charge and the surface potential of the toner are preferably $-2\sim-20$ μc/g and $-5\sim-80$V, respectively.

The magnetic toners which may be used in the method of the present invention are prepared from various materials.

Magnetic powders may be made of alloys and compounds such as ferrite and magnetite composed of ferromagnetic elements such as iron, cobalt and nickel, and various other alloys and compounds showing ferromagnetism by heat treatments or any other treatments. These ferromagnetic materials are contained in toner particles having particle sizes of several μm to several tens μm, so that they have preferably an average particle size of 0.1–3 μm or so. The amount of the magnetic powder contained in the toner is preferably 30–70 weight % based on the total weight of the toner. When it is less than 30 weight %, the toner does not have sufficient magnetism, resulting in the scattering of the toner particles from the sleeve. On the other hand, when it exceeds 70 weight %, the toner shows reduced capability of fixing because of the insufficiently small amount of a resin binder.

Resin binders for making the toner fixable may be selected properly depending on fixing methods used. For instance, when an oven heating method or a heat roll method is used for fixing, the following thermoplastic resins may be used. That is, homopolymers or copolymers of monomers such as styrenes, vinyl esters, esters of α-methylene aliphatic monocarboxylic acids, acrylonitrile, methacrylonitrile, acrylamide, vinyl ethers, vinyl ketones, N-vinyl compounds, etc. and their mixtures may be used. In addition, non-vinyl, thermoplastic resins such a rosin-modified phenolformaldehyde resins, bisphenol-typeepoxy resins, oil-modified epoxy resins, polyurethane resins, cellulose resins, polyether resins, polyester resins, etc. and their mixtures with the above vinyl resins may also be used.

Particularly for fixing by oven heating, bisphenoltype epoxy resins and bisphenol-type polyester resins are desirable, and for fixing by a heat roll styrene resins and polyester resins are desirable. As for the styrene resins, the more styrene components they have, the higher release characteristics they have to heat rolls. Further increase in the release characteristics to heat rolls can be achieved by adding aliphatic metal salts, low-molecular weight polyolefins, higher aliphatic acids having 28 or more carbon atoms, natural or synthetic paraffins, thermoplastic rubbers, etc.

On the other hand, when fixing is conducted by a pressure fixing method which applies only pressure at room temperature, pressure-sensitive resins such as higher aliphatic acids, higher aliphatic metal salts, higher aliphatic acid derivatives, higher aliphatic amides, waxes, rosin derivatives, alkyd resins, epoxy-modified phenol resins, natural resin-modified phenol resins, amino resins, silicone resins, polyurethanes, urea resins, polyester resins, oligomeric copolymers of acrylic acid or methacrylic acid with longchain alkyl acrylate or long-chain alkyl methacrylate, oligomeric copolymers of styrene with long-chain alkyl acrylate or long-chain alkyl methacrylate, polyolefins, ethylene-vinyl acetate copolymers, ethylene-vinyl alkyl ether copolymers, maleic anhydride copolymers, petroleum resins and rubbers may be used.

These resins may be used alone or in any combination, but to ensure high fluidity when used for toners those having glass transition temperatures of more than 40° C. or their mixtures may be effectively used.

Apart from the above components, various pigments and/or dyes used for usual dry developers may be added. The amounts of such additives in total are preferably less than 10 weight % based on the total weight of the toner from the viewpoint of electric characteristics of the toner. The pigments which may be used include carbon black, aniline blue, calco oil blue, chrome yellow, ultramarine blue, Du Pont oil red, quinoline yellow, methylene blue chloride, phthalocyanine blue, malachite green oxalate, lamp black, rose bengale and their mixtures. In case where magnetic powders are colored ones like magnetite, the pigments and the dyes are not necessarily added. And when carbon black is used, it should be within the range of 0.01–1 parts by weight per 100 parts by weight of the resin components of the toner to prevent the decrease in the insulating properties of the toner.

As for charge controlling agents, nigrosine dyes having positive triboelectric characteristics, nigrosine dyes modified with higher aliphatic acids, metal(Cr)-containing azo dyes having negative triboelectric characteristics, etc. may be used. Further, certain high-molecular dyes having stable charges as described in Japanese Patent Publication Nos. 51-28232 and 53-13284 may be used. Oxidized carbon black and resins having groups with positive or negative charge control characteristics may also be regarded as charge controlling agents. The amount of the charge controlling agent added is desirably within the rang of 0.1–5 weight %.

The magnetic toners used in the present invention may be prepared by known methods such as a pulverization method and a spray drying method using the above materials. For instance, in the case of the pulverization method, the toner materials are subjected to dry premixing, blended while heating, cooled and solidified, and the solidified products are pulverized and classified. The resulting toners have an average particle size of 5–30 μm, preferably 10–20 μm. After classification, the toner particles may be coated with various additives such as conductive particles (for instance, carbon black and tin oxide) and fine silica particles to adjust their electric resistance and fluidity.

Methods of conveying the magnetic toners to the developing zone are not restricted in the present invention. What is necessary is only to rotate at least one of the sleeve 3 and the permanent magnet means 4. Desirable among various toner conveying methods from the viewpoint of image qualities is a method of rotating the sleeve and the permanent magnet means in the same direction in such a rotational relationship that the magnetic toner can be conveyed in the opposite direction as a whole (see, for instance, U.S. Pat. No. 4,267,248). In this toner conveying method, the doctor gap and the developing gap are preferably 0.1–0.8 mm and 0.15–0.7 mm, respectively.

In the present invention, the triboelectric charges of toners are measured by a commercially available blow-off powder charge detector (TB-200 manufactured by Toshiba Chemical KK) under the following conditions. That is, 10 g of a carrier (Z200 manufactured by Nippon Iron Powder Co., Ltd.) and 0.5 g of a toner to be measured are introduced into a plastic container of 40 mm in outer diameter, the plastic container is rotated for 10 minutes, 200 mg of a sample is collected from the resulting mixture and poured into a container with a 325-mesh sieve, and then the triboelectric charge of the toner is measured by a flow surface angle measuring device under the conditions of a blow pressure of 1.0 $kg/cm^2$ and a blow time of 40 sec.

Figure 2:
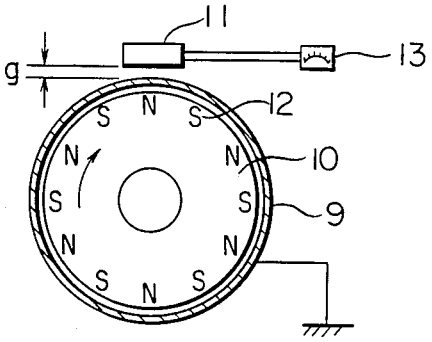
FIG. 2 is a cross-sectional view of an apparatus for measuring a toner surface potential.

The surface potential of the toner is measured by an apparatus as shown in FIG. 2. In FIG. 2, 9 indicates a non-magnetic sleeve of 50 mm in outer diameter, 10 a permanent magnet means of 46 mm in outer diameter and 150 mm in length with 12 symmetric magnetic poles 12 providing magnetic flux densities of 1000 G on the sleeve surface, 11 a probe and 13 a surface potential detector (Treck 344). The measurement is carried out by adjusting the gap between the sleeve surface and the probe 11 to 5 mm, supplying 3 g of a toner onto the sleeve 9, and detecting the surface potential of the toner after rotating the permanent magnet means 10 at 1000 rpm for one minute.

The electric resistance of the toner is measured by charging a proper amount (ten-odd milligrams) of a toner sample into a hollow Teflon® cylinder equipped with a dial gauge having an inner diameter of 3.05 mm, and detecting the resistance of the sample under a load of 0.1 kg in a DC electric field of 4 KV/cm. Resistivity is calculated from the measured electric resistance. Incidentally, the measurement of resistance is conducted by a 4329A-type insulation-resistance tester manufactured by Yokokawa-Hewlett Packard, Ltd.

Another aspect of the present invention is that the magnetic toner can be used in combination with a magnetic carrier. This provides the following advantages.

First of all, when chargeable magnetic toners are used alone, they somewhat tend to agglomerate by charges on a sleeve as their charges increase. The agglomerated toners are likely to be accumulated near a doctor blade, preventing sufficient toners from being conveyed to a developing zone on the sleeve, which in turn results in insufficient development. On the contrary, when the chargeable magnetic toners are used together with magnetic carriers, the agglomeration of the toners due to their charges can be prevented for sure because the toners are conveyed while being carried by the magnetic carriers.

Second, a developer consisting of the magnetic toner and the magnetic carrier enjoys an advantage that considerable changes of a mixing ratio of the toner to the carrier would hardly affect the image qualities. Because of this, this developer is not required to be controlled strictly with respect to toner concentration (within about ±0.5% from a reference value) unlike usual two component-type developers. What is needed usually is only to replenish the magnetic toner on a periodic basis. Further in this developer, the maximum amount of the magnetic toner conveyable with the magnetic carrier retained on a sleeve is always kept almost constant by the amount of the magnetic carrier, so that the toner concentration is controlled automatically. This makes it unnecessary to use a toner concentration control means unlike usual two component-type developers.

When the toner concentration is too low in a mixture of the magnetic toner and the magnetic carrier, dust consisting of dispersed toner particles is more likely to adhere to the image areas and the resulting images tend to be blurred. On the other hand, when the toner concentration is too high (when the carrier is insufficient), the toner is more likely to be scattered because of the increase in the amount of toner not conveyed by the carrier. Thus the toner concentration is preferably 30–90 weight %.

Incidentally, the magnetic carriers which are combined with the magnetic toners may be any known carriers such as iron particles, magnetite particles and ferrite particles. Carriers comprising iron oxides such as magnetite and ferrite are preferable. The most preferable are ferrite carriers as disclosed in Japanese Patent Laid-Open No. 59-182464 (U.S. Ser. No. 668,877).

The magnetic toners which are combined with such magnetic carriers have preferably the following charging characteristics. When the latent electrostatic image is positive they have preferably a triboelectric charge of −5∼−25 μc/g and a surface potential of −6∼−80V, and when the latent electrostatic image is negative they have preferably a triboelectric charge of 1–20 μc/g and a surface potential of 5–80V.

With this developer the development is conducted desirably under the following conditions.

The conveyance of the developer is preferably carried out by rotating at least a sleeve to prevent the magnetic agglomeration of the carrier particles. More preferable is to rotate a magnet roll in the opposite direction to that of the sleeve 2–10 times as fast as the sleeve. The circumferential speed of the sleeve is preferably 150–500 mm/sec.

The developing gap is preferably 1.0 mm or less to ensure sufficient contact of magnetic brush with the image-carrying drum surface, and 0.3 mm or more so that the magnetic brush can be kept in soft contact with the image-carrying drum surface. The doctor gap may be substantially the same as the developing gap.

The present invention will be explained in further detail by the following Examples without intention of restricting the scope of the present invention.

EXAMPLE 1

37 parts by weight of styrene-acrylic copolymer (P520 manufactured by Sekisui Chemical Co., Ltd.), 62 parts by weight of magnetite (EPT500 manufactured by Toda Kogyo Corp.) and 1 part by weight of a negative charge controlling agent (BONTRON E81 manufactured by Orient Chemical Industries Ltd.) were dry-mixed and blended at 200° C. by a kneader. The resulting blend was cooled and solidified and then pulverized by a jet mill to particles of 20 μm or less. The particles were charged into a super mixer and mixed with 0.5 part by weight of fine silica powder (R972 manufactured by Nippon Aerosil KK). The mixed powder was heat-treated in a hot air stream at 120° C. and then classified with the aid of an air flow by a zigzag classifier to provide a magnetic toner (No. A-1) having a particle size distribution of 5–20 μm. This magnetic toner had a triboelectric charge (hereinafter referred to as "TEC") of −5 μc/g and a surface potential of −31V.

Images were produced with this magnetic toner and evaluated under the following conditions.

A Se drum rotating at a circumferential speed of 150 mm/sec was uniformly charged to +800V by corona charging and exposed with a commercially available semiconductor laser to form a latent electrostatic image. The latent image was developed by the developing apparatus of FIG. 1, in which the sleeve 3 was a SUS 304 cylinder of 32 mm in outer diameter and the permanent magnet means 4 was a ferrite magnet roll having an outer diameter of 29.3 mm and 10 symmetrical magnetic poles and providing a magnetic flux density of 800 G on the sleeve surface. The doctor gap d and the developing gap D were 0.6 mm and 0.2 mm, respectively. The sleeve 3 and the permanent magnet means 4 were rotated in the same direction shown by the arrow X at 50 rpm and 1200 rpm, respectively, and the bias voltage was +700V.

The resulting toner image was transferred to a plain paper at transfer voltage of −4.5V, and then fixed by a heat roll method using a heat roll having a PFA resin surface coating and an RTV silicone rubber roll. The fixing conditions were a heat roll surface temperature of 180° C., a roll pressure of 1.0 kg/cm and a nipping width of 4.0 mm.

As a result, good print image having an optical density of 1.4 and resolution of 10 lines/mm was obtained substantially without dispersion of print image.

EXAMPLE 2

Three magnetic toners (Nos. A-2∼A-4) having different charging characteristics were prepared under the same conditions as in Example 1 except for changing the ratios of materials. No. A-2 toner had a TEC of −10 μc/g and a surface potential of −50V, No. A-3 toner had a TEC of −15 μc/g and a surface potential of −60V, and No. A-4 toner had a TEC of −20 μc/g and a surface potential of −90V.

These magnetic toners were used to produce print images in the same manner as in Example 1.

COMPARATIVE EXAMPLE 1

A magnetic toner (No. A-5) was prepared under the same conditions as in Example 1 except for using a positive charge controlling agent (BONTRON N03 manufactured by Orient Chemical Industries Ltd.). This magnetic toner had a TEC of +5 μc/g and a surface potential of +30V. This magnetic toner was used to form print images in the same way as in Example 1.

EXAMPLE 3

Two magnetic toners (Nos. A-6 and A-7) having different charging characteristics were prepared under the same conditions as in Example 1 except for changing the ratios of materials. No. A-6 toner had a TEC of −1 μc/g and a surface potential of −5V, and No. A-7 toner had a TEC of −25 μc/g and a surface potential of −100V.

These magnetic toners were used to form print images under the same conditions as in Example 1.

The compositions of the toners in the above Examples and Comparative Example ar shown in Table 1 together with their charging characteristics and image evaluation results.

TABLE 1

| Toner No. | Composition (parts by weight) Resin | Magnetic Powder | Charge Controlling Agent | Silica | Charging Characteristics TEC (μc/g) | Surface potential (V) | Image Qualities Optical Density | Resolution (line/mm) | Dust(1) |
|---|---|---|---|---|---|---|---|---|---|
| A-1 | 37 | 62 | 1 | 0.8 | −5 | −30 | 1.4 | 10 | O |
| A-2 | 38 | 60 | 2 | 0.5 | −10 | −50 | 1.5 | 10 | O |
| A-3 | 43 | 55 | 2 | 0.7 | −15 | −60 | 1.3 | 10 | O |
| A-4 | 47 | 50 | 3 | 0.9 | −20 | −90 | 1.2 | 10 | O |
| A-5 | 41 | 57 | 2 | 0.1 | +5 | +30 | 1.0 | 6 | X |
| A-6 | 33 | 66 | 1 | 0.3 | −1 | −5 | 1.1 | 8 | X |
| A-7 | 56 | 40 | 4 | 1.0 | −25 | −100 | 1.2 | 10 | X |

Note:
(1)O: Substantially no dust consisting of toner particles dispersed and adhered around the print image
X: Dust adhered Table 1 shows that better image qualities are obtained by using negatively chargeable magnetic toners (Nos. A-1~A-4, A-6 and A-7) rather than by using positively chargeable magnetic toners (No. A-5). Incidentally, the No. A-6 toner has slightly fewer charges so that it provides somewhat reduced optical density, and the No. A-7 toner has slightly larger charges so that it attracts somewhat more dispersed toner dust. However, both of them do not pose any practical problems.

EXAMPLE 4

A magnetic toner (No. A-8) was prepared under the same conditions as in Example 1 except for using a styreneacrylic copolymer (SBM-600 manufactured by Sanyo Chemical Industries, Ltd.), magnetite (EPT500 manufactured by Toda Kogyo Corp.) and a positive charge controlling agent (BONTRON N01 manufactured by Orient Chemical Industries Ltd.). This magnetic toner had a TEC of +5 μc/g and a surface potential of +20V.

This magnetic toner was used to form print images in the same way as in Example 1 except for using an OPC drum adapted to be charged negatively instead of the Se drum, charging the OPC drum surface at +800V, and applying a bias voltage of −600V and a transfer voltage of +5 KV.

As a result, good print image having an optical density of 1.3 and resolution of 10 lines/mm was obtained substantially without dispersed toner dust adhesion.

EXAMPLE 5

Three magnetic toners (Nos. A-9–A-11) having different charging characteristics were prepared under the same conditions as in Example 4 except for changing the ratios of materials. No. A-9 toner had a TEC of +8 μc/g and a surface potential of +40V, No. A-10 toner had a TEC of +16 μc/g and a surface potential of +65V, and No. A-11 toner had a TEC of +19 μc/g and a surface potential of +80V.

These magnetic toners were used to produce print images in the same manner as in Example 4.

COMPARATIVE EXAMPLE 2

A magnetic toner (No. A-12) was prepared under the same conditions as in Example 4 except for using a negative charge controlling agent (BONTRON E84 manufactured by Orient Chemical Industries Ltd.). This magnetic toner had a TEC of −3 μc/g and a surface potential of −30V. This magnetic toner was used to form print images in the same way as in Example 4.

EXAMPLE 6

Two magnetic toners (Nos. A-13 and A-14) having different charging characteristics were prepared under the same conditions as in Example 4 except for changing the ratios of materials. No. A-13 toner had a TEC of +2 μc/g and a surface potential of +6V, and No. A-14 toner had a TEC of +27 μc/g and a surface potential of +97V.

These magnetic toners were used to form print images under the same conditions as in Example 4.

The compositions of the toners in the above Examples 4–6 and Comparative Example 2 are shown in Table 2 together with their charging characteristics and image evaluation results.

TABLE 2

| Toner No. | Composition (parts by weight) Resin | Magnetic Powder | Charge Controlling Agent | Silica | Charging Characteristics TEC (μc/g) | Surface potential (V) | Image Qualities Optical Density | Resolution (line/mm) | Dust(1) |
|---|---|---|---|---|---|---|---|---|---|
| A-8 | 38 | 60 | 2 | 1.0 | +5 | +20 | 1.3 | 10 | O |
| A-9 | 37 | 60 | 3 | 0.5 | +8 | +40 | 1.32 | 10 | O |
| A-10 | 47 | 50 | 3 | 0.5 | +16 | +65 | 1.27 | 10 | O |
| A-11 | 56 | 40 | 4 | 0.3 | +19 | +80 | 1.15 | 10 | O |
| A-12 | 38 | 60 | 2 | 1.0 | −3 | −30 | 1.0 | 6 | X |
| A-13 | 34 | 65 | 1 | 1.0 | +2 | +6 | 1.10 | 8 | Δ |

TABLE 2-continued

| Toner No. | Resin | Composition (parts by weight) Magnetic Powder | Charge Controlling Agent | Silica | Charging Characteristics TEC (μc/g) | Surface potential (V) | Image Qualities Optical Density | Resolution (line/mm) | Dust(1) |
|---|---|---|---|---|---|---|---|---|---|
| A-14 | 61 | 35 | 4 | 0.3 | +27 | +97 | 1.07 | 8 | Δ |

Note:
(1)O: Not substantially adhered
X: Adhered
Δ: Slightly adhered

Table 2 shows that better image qualities are obtained by using positively chargeable magnetic toners (Nos. A-8~11, A-13 and A-14) rather than by using negatively chargeable magnetic toners (No. A-12). Incidentally, the No. A-13 toner has slightly fewer charges so that it provides somewhat reduced optical density, and the No. A-14 toner has slightly larger charges so that it attracts somewhat more dispersed toner dust. However, both of them do not pose any practical problems.

EXAMPLE 7

A resin mixture of a polyethylene wax (HIWAX200P manufactured by Mitsui Petrochemical Industries, Ltd.) and an ethylene-vinyl acetate copolymer (ACP400 manufactured by Allied Corp.) in a weight ratio of 7:3, magnetite (EPT500 manufactured by Toda Kogyo Corp.) and a positive charge controlling agent (BONTRON N01 manufactured by Orient Chemical Industries Ltd.) were dry-mixed in ratios shown in Table 3 below, and blended at 200° C. by a kneeder. Each of the resulting blends was cooled and solidified and then pulverized by a jet mill to particles of 20 μm or less. The particles were charged into a super mixer and mixed with 0.1–0.5 part by weight of fine silica powder (R972 manufactured by Nippon Aerosil KK). The mixed powders were heat-treated in a hot air stream at 120° C. and then classified with the aid of an air flow by a zigzag classifier to provide magnetic toners (Nos. B-1~B-4) each having a particle size distribution of 5–20 μm. These magnetic toners had triboelectric charges (TEC) and surface potentials shown in Table 3.

Similarly magnetic toners (Nos B-5~B-7) having different TECs and surface potentials were prepared in the same manner. Incidentally, it is to be noted that the No. B-5 magnetic toner differs from the other toners in that it contains a negative charge controlling agent (BONTRON E81 manufactured by Orient Chemical Industries Ltd.).

Images were produced with these magnetic toners and evaluated under the following conditions.

An OPC drum with negative charging characteristics rotating at a circumferential speed of 150 mm/sec was uniformly charged at −800V by a corona charging device and exposed with a commercially available semiconductor laser to form a latent electrostatic image. The latent image was developed by the developing apparatus of FIG. 1 under the same conditions as in Example 1 except for applying a DC bias voltage of −700V to the sleeve. The resulting toner image was transferred to a plain paper and then fixed by a cold pressure-fixing method at a linear pressure of 19 kg/cm. The image qualities were measured in the same way as in Example 1. The results are shown in Table 3.

TABLE 3

| Toner No.(1) | Resin | Composition (parts by weight) Magnetic Powder | Charge Controlling Agent | Silica | Charging Characteristics TEC (μc/g) | Surface potential (V) | Image Qualities Optical Density | Resolution (line/mm) | Dust(2) |
|---|---|---|---|---|---|---|---|---|---|
| B-1 | 28 | 70 | 2 | 0.1 | +3 | +5 | 1.3 | 6.3 | O |
| B-2 | 37 | 60 | 3 | 0.3 | +7 | +10 | 1.4 | 8 | O |
| B-3 | 47.5 | 55 | 2.5 | 0.3 | +12 | +30 | 1.4 | 8 | O |
| B-4 | 62.5 | 35 | 2.5 | 0.5 | +18 | +50 | 1.5 | 6.3 | O |
| B-5 | 38.5 | 60 | 1.5 | 0.5 | −10 | −30 | 0.4 | 4 | X |
| B-6 | 24 | 75 | 1 | 0.5 | +1 | +4 | 0.6 | 5 | X |
| B-7 | 56 | 40 | 4 | 0.2 | +22 | +65 | 1.6 | 4 | X |

Note:
(1)B-1~4: Examples, B-5~7: Comparative Examples
(2)O: Not Substantially adhered,
X: Adhered As is evident from Table 3, the toners Nos. B-1~B-4 have positive charging characteristics and proper levels of triboelectric charges (TEC) and surface potentials, so that they can provide high-quality images having high optical density and resolution with substantially no dispersed toner dust adhesion. On the contrary, the No. B-5 toner has negative charging characteristics so that it provides only images having low optical density and resolution with substantial dust adhesion. In addition, although the toners (Nos. B-6 and B-7) have positive charging characteristics, the No. B-6 toner gives poor image qualities because of its small charges, and the No. B-7 toner gives high optical density but poor resolution with substantial dust adhesion because of its excessive charges.

EXAMPLE 8

A resin mixture of a polyethylene wax (HIWAX200P manufactured by Mitsui Petrochemical Industries, Ltd.) and an ethylene-vinyl acetate copolymer (ACP400 manufactured by Allied Corp.) in a weight ratio of 7:3, magnetite (EPT500 manufactured by Toda Kogyo Corp.) and a negative charge controlling agent (BONTRON E81 manufactured by Orient Chemical Industries Ltd.) were dry-mixed in ratios shown in Table 4 below. Magnetic toners (Nos. C-1~C-4) each having a particle size distribution of 5–20 μm were obtained in the same manner as in Example 7 except for using 0.5 part by weight of fine silica powder in every case. These magnetic toners had triboelectric charges (TEC) and surface potentials shown in Table 4.

Similarly magnetic toners (Nos. C-5~C-7) having different TECs and surface potentials were prepared in the same manner. Incidentally, it is to be noted that the No. C-5 magnetic toner differs from the other toners in that it contains a positive charge controlling agent (BONTRON N01 manufactured by Orient Chemical Industries Ltd.).

Images were produced with these magnetic toners and evaluated under the following conditions.

An OPC drum with positive charging characteristics rotating at a circumferential speed of 150 mm/sec was uniformly charged at +800V by a corona charging device and exposed with a commercially available semiconductor laser to form a latent electrostatic image. The latent image was developed by the developing apparatus of FIG. 1 under the same conditions as in Example 7 except for applying a DC bias voltage of +700V to the sleeve. The resulting toner image was transferred to a plain paper and then fixed in the same manner as in Example 7. The image qualities were evaluated and the results are shown in Table 4.

TABLE 4

| Toner No.(1) | Resin | Composition (parts by weight) Magnetic Powder | Charge Controlling Agent | Silica | Charging Characteristics TEC (μc/g) | Surface potential (V) | Image Qualities Optical Density | Resolution (line/mm) | Dust(2) |
|---|---|---|---|---|---|---|---|---|---|
| C-1 | 28 | 70 | 2 | 0.5 | −3 | −5 | 1.2 | 8 | O |
| C-2 | 34 | 63 | 3 | 0.5 | −7 | −10 | 1.3 | 8 | O |
| C-3 | 43 | 55 | 2 | 0.5 | −12 | −30 | 1.4 | 8 | O |
| C-4 | 58 | 40 | 2 | 0.5 | −18 | −50 | 1.5 | 6.3 | O |
| C-5 | 47 | 50 | 3 | 0.2 | +10 | +30 | 0.3 | 4 | X |
| C-6 | 28 | 72 | 0 | 0.5 | −1 | −4 | 0.7 | 5 | X |
| C-7 | 59 | 35 | 6 | 1.0 | −22 | −85 | 1.6 | 4 | X |

Note:
(1)C-1~4: Examples, C-5~7: Comparative Examples
(2)O: Not Substantially adhered,
X: Adhered As is evident from Table 4, the toners Nos. C-1~C-4 have negative charging characteristics and proper levels of triboelectric charges (TEC) and surface potentials, so that they can provide high-quality images having high optical density and resolution with substantially no dust. On the contrary, the No. C-5 toner has positive charging characteristics so that t provides only images having low optical density and resolution with substantial dust adhesion. In addition, although the toners (Nos. C-6 and C-7) have negative charging characteristics, the No. C-6 toner gives poor image qualities because of its small charges, and the No. C-7 toner gives high optical density but poor resolution with a lot of dust because of its excessive charges.

EXAMPLE 9

Combinations of the following magnetic carrier and various magnetic toners were used.

Ferrite carrier (KBN-100 manufactured by Hitachi Metals, Ltd.) having a particle size of 70–140 μm: 60 weight %

Various magnetic toners each having a particle size distribution of 5–20 μm: 40 weight %

The above magnetic toners were obtained in the same manner as in Example 1 except for dry-mixing a styreneacrylic resin (P520 manufactured by Sekisui Chemical Co., Ltd.), magnetite (EPT500 manufactured by Toda Kogyo Corp.) and a negative charge controlling agent (BONTRON E81 manufactured by Orient Chemical Industries Ltd.) in various ratios shown in Table 5. The resulting magnetic toners (No. D-1~ D-4) had triboelectric charges (TEC) and surface potentials shown in Table 5.

Similarly magnetic toners (Nos. D-5~D-7) having different TECs and surface potentials were prepared in the same manner. Incidentally, it is to be noted that the No. D-5 magnetic toner contained a positive charge controlling agent (BONTRON N03 manufactured by Orient Chemical Industries Ltd.).

Images were produced with these magnetic toners and evaluated under the following conditions.

An OPC drum with positive charging characteristics rotating at a circumferential speed of 150 mm/sec was uniformly charged at +800V by a corona charging device and exposed with a commercially available semiconductor laser to form a latent electrostatic image. The latent image was developed by the developing apparatus of FIG. 1, in which the sleeve 3 was a SUS 304 cylinder of 32 mm in outer diameter and the permanent magnet means 4 was a ferrite magnet roll having an outer diameter of 29.3 mm and 10 symmetrical magnetic poles and providing a magnetic flux density of 800 G on the sleeve surface. The doctor gap d and the developing gap D were 0.2 mm and 0.3 mm, respectively. The sleeve 3 was rotated in the direction of the arrow Y at 200 rpm and the permanent magnet means 4 was rotated in the direction of the arrow X at 1000 rpm. The DC bias voltage applied to the sleeve 3 was +700V. The resulting toner image was transferred to a plain paper and then fixed by a heat roll method using a heat roll at 180° C. under a linear pressure of 1 kg/cm.

The evaluation of the image qualities were carried out in the same manner as in Example 1. The results are shown in Table 5.

TABLE 5

| Toner No. | Resin | Composition (parts by weight) Magnetic Powder | Charge Controlling Agent | Silica | Charging Characteristics TEC (μc/g) | Surface potential (V) | Image Qualities Optical Density | Resolution (line/mm) | Dust(1) |
|---|---|---|---|---|---|---|---|---|---|
| D-1 | 34 | 65 | 1 | 0.5 | −5 | −9 | 1.17 | 8 | O |
| D-2 | 48 | 50 | 2 | 0.5 | −12 | −30 | 1.32 | 10 | O |
| D-3 | 52 | 45 | 3 | 0.5 | −17 | −60 | 1.41 | 10 | O |
| D-4 | 62 | 35 | 3 | 0.5 | −21 | −70 | 1.28 | 8 | O |
| D-5 | 56 | 40 | 4 | 0.5 | +15 | +60 | 0.43 | 4 | X |
| D-6 | 35 | 65 | 0 | 0.5 | −3 | −5 | 1.30 | 4 | X |
| D-7 | 80 | 15 | 5 | 0.5 | −28 | −120 | 0.58 | 5.6 | X |

Note:
(1)O: Not Substantially adhered
X: Adhered

As is evident from Table 5, the toners Nos. D-1~D-4 provided high-quality images having high optical density and resolution with substantially no dust adhesion. On the contrary, the toners (Nos. D-5~D-7) suffered from the adhesion of a lot of dispersed toner dust around the peripheries of the images. Particularly, the toners (Nos. D-5 and D-7) gave low optical density and resolution.

EXAMPLE 10

Combinations of the following magnetic carrier and various magnetic toners were used.

Ferrite carrier (KBN-100 manufactured by Hitachi Metals, Ltd.) having a particle size of 70–140μm: 60 weight %

Various magnetic toners each having a particle size distribution of 5–20 μm: 40 weight %

The above magnetic toners were obtained in the same manner as in Example 1 except for dry-mixing a styrene-acrylic resin (P520 manufactured by Sekisui Chemical Co., Ltd.), magnetite (EPT500 manufactured by Toda Kogyo Corp.) and a positive charge controlling agent (BONTRON N03 manufactured by Orient Chemical Industries Ltd.) in various ratios shown in Table 6. The resulting magnetic toners (Nos. E-1~E-3) had triboelectric charges (TEC) and surface potentials shown in Table 6.

Similarly magnetic toners (Nos. E-4 and E-5) having different TECs and surface potentials were prepared in the same manner. Incidentally, it is to be noted that the No. E-5 magnetic toner contained a negative charge controlling agent (BONTRON E81 manufactured by Orient Chemical Industries Ltd.).

Images were produced with these magnetic toners and evaluated under the following conditions.

An OPC drum with negative charging characteristics rotating at a circumferential speed of 150 mm/sec was uniformly charged at −800V by a corona charging device and exposed with a commercially available semiconductor laser to form a latent electrostatic image. The latent image was developed by the developing apparatus of FIG. 1, in which the sleeve 3 was a SUS 304 cylinder of 32 mm in outer diameter and the permanent magnet means 4 was a ferrite magnet roll having an outer diameter of 29.3 mm and 10 symmetrical magnetic poles and providing a magnetic flux density of 800 G on the sleeve surface. The doctor gap d and the developing gap D were 0.3 mm and 0.4 mm, respectively. The sleeve 3 was rotated in the direction of the arrow Y at 200 rpm and the permanent magnet means 4 was rotated in the direction of the arrow X at 1000 rpm. The DC bias voltage applied to the sleeve 3 was −700V. The resulting toner image was transferred to a plain paper and then fixed by a heat roll method using a heat roll at 180° C. under a linear pressure of 1 kg/cm.

The evaluation of the image qualities were carried out in the same manner as in Example 1. The results are shown in Table 6.

TABLE 6

| Toner No. | Resin | Composition (parts by weight) Magnetic Powder | Charge Controlling Agent | Silica | Charging Characteristics TEC (μc/g) | Surface potential (V) | Image Qualities Optical Density | Resolution (line/mm) | Dust(1) |
|---|---|---|---|---|---|---|---|---|---|
| E-1 | 33 | 65 | 2 | 0.5 | +3 | +10 | 1.15 | 8 | O |
| E-2 | 43 | 55 | 2 | 0.5 | +11 | +40 | 1.3 | 10 | O |
| E-3 | 62 | 35 | 3 | 0.5 | +18 | +70 | 1.4 | 10 | O |
| E-4 | 80 | 15 | 5 | 0.5 | +23 | +140 | 0.7 | 6 | O |
| E-5 | 50 | 50 | 0 | 0.5 | −10 | −20 | 0.4 | 4 | X |

Note:
(1)O: Not Substantially adhered
X: Adhered

As is evident from Table 6, the toners (Nos. E-1~E-3) provided high-quality images having high optical density and resolution with substantially no dust adhesion. On the contrary, the No. E-4 toner provided only images having low optical density, though it did not suffer from dust adhesion. And the No. E-5 toner gave low optical density and resolution with substantial dust adhesion around the image peripheries.

As described above in detail, the use of chargeable magnetic toners adapted be to charged with the opposite polarity to that of latent electrostatic images according to the present invention can produce reversal development images with high image qualities particularly in terms of resolution substantially without suffering from dispersed toner dust adhesion around the image peripheries.

The present invention has been explained by the Examples, but it should be noted that the present invention is not restricted thereto and that any modification can be made unless it deviates from the scope of the present invention.

What is claimed is:

1. A reversal development method comprising the steps of:

forming a latent electrostatic image on the surface of an image-carrying member having predetermined charging characteristics;

supplying a developer to a non-magnetic, conductive sleeve containing a magnetic field generating means and positioned opposite to said image-carrying member, with a development gap of less than or equal to about 1.0 mm between the sleeve and the image carrying member, said developer comprising a magnetic toner consisting essentially of a resin and magnetic powder, said supplying step including the step of using toner of the type having high resistivity and having a triboelectric charge characteristic of opposite polarity to that of said latent electrostatic image, said charge being on the order of 1–20 μC/g and yielding a surface potential of about 5–90V, both absolute values;

conveying said developer onto said image-carrying member surface by relative rotation of said sleeve to said magnetic field-generating means; and applying DC voltage of the same polarity as that of said latent electrostatic image to said sleeve so that said magnetic toner is attracted to the nonimage areas of said latent electrostatic image, whereby high quality images having high optical density and resolution with substantially no unwanted toner dust adhesion, are produced.

2. The reversal development method according to claim 1, wherein said developer consists of a magnetic toner.

3. The reversal development according to claims 2, wherein said magnetic toner has a triboelectrical charge of 1 to 20 μc/g and a surface potential of 10 to 90V, both as absolute values.

4. The reversal development method according to claim 2, wherein said latent image forming step includes forming a negatively charged latent image, and wherein said magnetic toner is a pressure fixing-type magnetic toner having a triboelectric charge of 2 to 20 μc/g and a surface potential of 5 to 60V.

5. The reversal development method according to claim 2 wherein said latent image forming step includes forming a positively charged latent image, and wherein said magnetic toner is a pressure fixing-type magnetic toner having a triboelectric charge of −2 to −20 μc/g and a surface potential of −5 to −80V.

6. The reversal development method according to claim 1, wherein said developer consists essentially of a magnetic toner and a magnetic carrier.

7. The reversal development method according to claim 6, wherein said latent image forming step includes forming a positively charged latent image, wherein said magnetic toner has a triboelectric charge of −5 to −25 μc/g and a surface potential of −6 to −80V.

8. The reversal development method according to claim 6, wherein said latent image forming step includes forming a negatively charged latent image, wherein said magnetic toner has a triboelectric charge of 1 to 20 μc/g and a surface potential of 5 to 80V.

* * * * *